United States Patent [19]

Chesluk et al.

[11] 3,953,319

[45] Apr. 27, 1976

[54] PREPARATION OF REFRIGERATION OILS

[75] Inventors: Ralph P. Chesluk, Nederland; Howard J. Platte, Houston; Edward C. Brink, Jr., Port Arthur, all of Tex.

[73] Assignee: Texaco Inc., New York, N.Y.

[22] Filed: Sept. 9, 1974

[21] Appl. No.: 504,617

[52] U.S. Cl. ..... 208/25; 208/14; 208/264

[51] Int. Cl.[2] ..... C10G 23/00

[58] Field of Search ..... 208/14, 18, 25, 264

[56] References Cited

UNITED STATES PATENTS

| | | | |
|---|---|---|---|
| 2,658,887 | 11/1953 | Arnold et al. | 208/25 |
| 3,145,161 | 8/1964 | Anderson et al. | 208/14 |
| 3,520,796 | 7/1970 | Murphy et al. | 208/18 |
| 3,684,684 | 8/1972 | Coleman et al. | 208/18 |

FOREIGN PATENTS OR APPLICATIONS

| | | | |
|---|---|---|---|
| 743,525 | 9/1966 | Canada | 208/14 |

*Primary Examiner*—Herbert Levine
*Attorney, Agent, or Firm*—T. H. Whaley; C. G. Ries; Robert Knox, Jr.

[57] ABSTRACT

Refrigeration oils are prepared by subjecting a crude lubricating oil fraction to mild hydrogenation, acid treating, dewaxing and clay percolation.

10 Claims, No Drawings

PREPARATION OF REFRIGERATION OILS

This invention relates to the production of refrigeration oils having good chemical/thermal stability, low pour and haze points, low aniline points and good solubility for Freon refrigerants.

By the nature of the usage to which they are put, which usually involves operation in a sealed unit for periods of time extending from 10–29 years, refrigeration oils require special properties not necessary in conventional lubricating oils. These refrigeration oils must have good chemical and thermal stability, must have satisfactory miscibility with low molecular weight halogenated hydrocarbons, and must have low pour and haze points to perform properly in a refrigeration compressor environment.

Commercially, refrigeration oils are prepared by subjecting the crude lubricating oil to solvent extraction, using a solvent having an affinity for aromatics such as furfural, sulfur dioxide, dimethyl formamide, N-methyl pyrrolidone and the like, to remove the aromatics from the crude oil. The solvent refined oil is then acid-treated with concentrated sulfuric acid to improve the color, stability and oxidation resistance of the oil. It is also dewaxed preferably using a urea-alcohol solution to remove waxy materials thereby lowering the pour, floc and haze points of the oil. Usually the final stage is a clay percolation, the purpose of which is to improve the color, neutralize the oil after the acid treatment and further improve chemical and thermal stability.

We have now discovered that superior refrigeration oils may be prepared by a process sequence in which the crude lubricating oil is subjected to a hydrofinishing treatment and the hydrofinished oil is then acid treated. urea dewaxed and clay percolated.

The first step in the process of our invention is a hydrofinishing step. Ordinarily in the petroleum refining industry there are considered to be three types of hydrogenation, namely hydrocracking, hydrotreating and hydrofinishing.

Hydrocracking or destructive hydrogenation, as it was previously called, is a severe reaction in which the hydrocarbon oil is passed into contact with a hydrocracking catalyst in the presence of added hydrogen. Reaction conditions are relatively severe with temperatures of about 700°–850°F. and pressures of 800 to as high as 2500 psig being employed. The purpose of the hydrocracking reaction is to convert a large portion of the charge into lighter boiling materials. To this end the catalyst, in addition to having hydrogenating properties, is also an active cracking catalyst. Generally the catalyst will comprise a Group VIII metal and optionally a Group VI metal with an acidic support having substantial cracking activity such as a zeolite of reduced alkali metal content preferably composited with a refractory inorganic oxide such as silica or alumina. It is not unusual in commercial hydrocracking processes for at least 60% of the product to boil below the initial boiling point of the feed to the hydrocracking unit.

Hydrotreating is less severe than hydrocracking and is generally used for desulfurization and/or denitrogenation of the charge stock with considerable aromatic saturation accompanying these reactions. The operating conditions are substantially the same as those used for hydrocracking and the catalyst ordinarily will contain the same hydrogenating components as the hydrocracking catalyst but the support will have little if any cracking activity. The principal purpose of the hydrotreating reaction is to saturate aromatics and to cause the rupture of C-S and C-N bonds with the formation of $H_2S$ and $NH_3$ thereby effecting desulfurization and denitrogenation of the feed stock. Some lower molecular weight compounds are formed in the hydrotreating process due to the breaking of these bonds.

The third type of hydrogenation used in the petroleum refining industry is termed hydrofinishing. This is an extremely mild hydrogenation reaction and as the name implies is generally used as a final or "finishing" step in the processing of lubricating oils and has been suggested as a substitute for clay percolation and acid treating. Ordinarily its main function has been to serve as a final step in the production of a lubricating oil to improve the color of the oil.

In the process of the present invention, the first step to which the crude lubricating oil charge is subjected is a hydrofinishing step. The charge is introduced into contact with the hydrofinishing catalyst at a temperature between about 500° and 650°F. preferably 600°–625°F. and a pressure between about 100 and 1500 psig, preferably 200–500 psig. Hydrogen is introduced at a rate of between about 100 and 10,000 scfb preferably 200–1000 scfb. The space velocity of the charge in terms of volumes of oil per volume of catalyst per hour may range between 0.1 and 10, a preferred range being 0.5–2. It will be obvious to those skilled in the art that any combination of the above ranges is not satisfactory for hydrofinishing. For example, if a temperature near the upper limit of the range is used then the space velocity should be increased accordingly as a low space velocity with high temperature would result in conditions that would induce cracking which is not desired in the hydrofinishing step.

The hydrogen used in the hydrofinishing step need not necessarily be pure. It should have a purity of at least about 60% with a purity of between about 70 and 90% being preferred. Hydrogen obtained by the partial oxidation of hydrocarbonaceous material followed by shift conversion and $CO_2$ removal, by-product hydrogen produced in the reforming of naphtha and electrolytic hydrogen are suitable.

The catalyst used in the hydrofinishing step of the present invention comprises a hydrogenating component on a substantially inert support. The hydrogenating component may comprise a Group VIII metal or compound thereof in conjunction with a Group VI metal or compound thereof. Suitable Group VIII metals are iron, nickel and cobalt and Group VI metals tungsten and molybdenum. Satisfactory combinations are nickel-molybdenum, cobalt-molybdenum, nickel tungsten and nickel-cobalt molybdenum. Ordinarily the metals are present either as the oxide or sulfide. Usually the Group VIII metal is present in an amount between about 1 and 10% preferably about 1.5 to 5%. When present, the Group VI metal may amount to between 5 and 30% preferably 8–26% by weight of the catalyst composite. The hydrogenating component is supported on an inert refractory inorganic oxide such as alumina, silica, zirconia, beryllia, magnesia and the like and mixtures thereof. Preferably, the catalyst is used as a fixed bed of particles having a cylindrical shape. Reactant flow may be upward or downward through the bed or the hydrogen flow may be upward countercurrent to the downwardly flowing oil. In a preferred embodiment, both oil and hydrogen are passed downwardly through the bed.

To impart chemical and thermal stability to the hydrofinished oil, it is subjected to acid treatment. This involves contacting the oil with concentrated (95%–98%) sulfuric acid at a temperature between ambient and about 150°F. Amounts ranging from between about 15 and 50 lbs. of acid per barrel of oil may be used, a preferred amount being between about 25 and 50 lbs. of concentrated sulfuric acid per barrel of oil. The mixture is allowed to settle and the upper acid-treated oil layer is separated from the lower acid layer. The separated oil layer is then neutralized, e.g. by treatment with 15° Be caustic. After settling, the aqueous caustic layer is drawn off, and the oil layer which may contain trace quantities of sodium salts is water washed at a temperature ranging from 170°–200°F. by injecting dry steam. The dry steam also provides desired agitation to insure good mixing. After steaming the mixture is allowed to settle and the separated water is drawn off. Oil remaining is checked for pH, and if not neutral, water washing at 170°–200°F is repeated. The final neutral oil is hazy due to retained water which is removed by heating the oil at 150°–200°F. with either air or nitrogen blowing. Preferred brightening temperatures is 160°–180°F. The brightened oil is dewaxed to remove waxy componnents which interfere with product pour and Freon haze points.

Dewaxing may be effected by any conventional treatment such as by mixing the oil heated to a temperature above the melting point of the wax with a solvent such as a mixture of methyl ethyl ketone and toluene, cooling the oil to precipitate wax therefrom and filtering the wax from the chilled oil. A preferred treatment involves contacting the oil with a methanol-isopropanol-urea solution to form a urea-wax complex which is filtered and the dewaxed oil recovered from the filtrate by stripping off retained methanol and isopropanol. The mixture of oil, alcohol mixture, and urea are mixed at 110°–115°F. No heat is applied to the mixing kettle. The oil to be dewaxed is heated in the storage tank prior to charging to the mixing kettle. The mixing is carried out for 4 hours with recycling. After 4 hours, a sample is removed and Freon Floc and Haze are determined. The mixing is continued while testing is in progress; usually this is an additional two hours. Wax-urea complex is then removed by filtration.

For each 100 bbl. of oil to be dewaxed, from about 300 to 600 lbs. of urea may be used with from about 65 to 110 gallons of a mixture of methanol and isopropanol preferably in a volume ratio of 2 parts of methanol per part of isopropanol. Preferred amounts are from 350 to 500 lbs. urea and 70 to 100 gallons of alcohol mixture per 100 bbl. of oil.

In the final step in our process the hydrofinished, acid-treated dewaxed oil is percolated through a bed of clay at a rate of between about 0.1 and 5 barrels of oil per ton of clay per hour, a preferred rate being between 1 and 1.5. Total throughput ordinarily will amount to about between 25 and 100 barrels of oil per ton of clay.

The product obtained from the process of our invention has good chemical/thermal stability and good Freon/oil solubility.

The following examples are given for illustrative purposes only and it should not be construed that the invention is restricted thereto.

EXAMPLE I

In this example the charge stock, an 80 pale oil having the characteristics listed in column 1 of Table 1 below, is subjected to hydrofinishing by being passed through a bed of catalyst pellets composed of 2% cobalt and 10 % molybdenum supported on alumina at a temperature of 625°F., a pressure of 300 psig and a space velocity of 1.2 volumes of oil per volume of catalyst per hour with hydrogen introduced at a rate of 265 scfb.

The characteristics of the product are listed in column 2 of Table 1 below. The hydrofinished oil is then contacted with 50 lbs. of 98% sulfuric acid per barrel of oil in 3 stages, 10 lbs. of acid per barrel being used in the first stage, 15 lbs. in the second stage and 25 lbs. in the third stage. The oil is then neutralized with 15°Be caustic, washed and then brightened by bubbling air therethrough at 170°F. The characteristics of the hydrofinished, acid-treated oil are listed in column 3 of Table 1.

The hydrofinished, acid-treated oil is then dewaxed by being mixed at a temperature of 110°–115°F. with urea and an isopropyl-methyl alcohol mixture containing 2 parts methyl alcohol per part isopropyl alcohol per part isopropyl alcohol in the relative proportions of 4 lbs. urea and 0.8 gallons alcohol per barrel of oil. Characteristics of the hydrofinished acid-treated, urea-dewaxed oil are listed in column 4 of Table 1 below.

The hydrofinished, acid-treated, urea-dewaxed oil is then percolated through a bed of clay at a rate of 1.0 barrel per ton of clay per hour. The characteristics of the finished refrigeration oil are listed in column 5 of Table I.

By way of comparison, when the same charge is subjected to conventional treatment for the production of a refrigeration oil by treatment with $SO_2$ at 60°F. and 85% dosage, the resulting oil is acid treated at a dosage of 50 lbs. per barrel, urea dewaxed using the same conditions described above and then percolated through a bed of clay at a rate of 1 barrel per ton of clay per hour, there is obtained an oil having the characteristics listed in column 6 of Table I.

TABLE 1

| | 1 | 2 | 3 | 4 | 5 | 6 |
|---|---|---|---|---|---|---|
| Gravity, °API | 23.5 | 23.8 | 25.0 | 25.0 | 25.4 | 27.7 |
| Flash, COC, °F. | 335 | 325 | 330 | 310 | 340 | 320 |
| Viscosity, SUS at 100°F. | 83.6 | 82.2 | 83.2 | 83.4 | 82.9 | 83.8 |
| Aniline Point, °F. | 148 | 152 | 158 | 158 | 157 | 180 |
| Freon Haze, °F. | — | | −60 | <−95 | −90 | −70 |
| Freon Floc, °F. | — | | −80 | <−95 | <−100 | −90 |
| Color, ASTM | — | | — | | <0.5 | 0.5 |
| Sealed tube stability R-22, % at 14 days | — | | | | 0.17 | 0.25 |
| Frigidaire Heat Stability, 14 days at 400°F., mg. of | | | | | | |

TABLE 1-continued

| | 1 | 2 | 3 | 4 | 5 | 6 |
|---|---|---|---|---|---|---|
| chloride | — | | | | 18 | 160 |
| Consolute Temp., °F. | | | | | −8 | +22 |
| Copper Proclivity, Hrs. to copper plating | | | | | 406 | 168 |

EXAMPLE II

This example is a substantial duplicate of Example I, the differences being that the charge is a 300 pale oil stock and the acid treating is effected in three stages using 10 lbs. of acid per barrel of oil in the first stage, 4 lbs. of acid per barrel of oil in the second stage and 20 pounds of acid per barrel in the third stage making a total of 34 lbs. of acid per barrel of oil. Characteristics of the product are tabulated below in the same manner as in Table 1. In column 6 of Table 2, there are tabulated the characteristics of an oil obtained by treating a 300 pale oil stock in the same manner as described in Example I for the conventional production of a refrigeration oil.

TABLE 2

| | 1 | 2 | 3 | 4 | 5 | 6 |
|---|---|---|---|---|---|---|
| Gravity, °API | 21.2 | 22.2 | 22.7 | 22.4 | 22.4 | 25.3 |
| Flash, COC, °F. | 390 | 385 | 400 | 375 | 365 | 400 |
| Viscosity, SUS at 100°F. | 330 | 312 | 302 | 304 | 302 | 313 |
| Aniline Point, °F. | 165 | 165 | 172 | 171 | 171 | 197 |
| Freon Haze, °F. | — | −40 | −30 | −75 | −80 | −55 |
| Freon Floc, °F. | | −40 | −30 | −90 | −100 | −70 |
| Color, ASTM | | | | | <1.0 | <1.5 |
| Sealed tube stability R-22, % at 14 days | | | | | 0.51 | 1.1 |
| Frigidaire Heat Stability 14 days at 400°F. mg. of chloride | | | | | 178 | 434 |
| Consolute Temp., °F. | | | | | +48 | +77 |
| Copper Proclivity, Hrs. to copper plating | | | | | 264 | 48 |

The above data show that not only does the process of the present invention produce a superior refrigeration oil but in addition, it produces them in greater yield as in conventional processing the yield across the solvent refining step ranges between 70 and 75% of the charge whereas the lube oil fraction of the hydrofinished oil is obtained in a yield of between 95% and 100% by weight based on the feed to the hydrofinishing zone.

In systems using refrigerants which are miscible with the oil, floc point and haze point tests are valuable indicators of the low temperature performance of the oil. Both of these tests are conducted on a mixture of ten percent oil in Refrigerant 12 (Freon 12) sealed in a glass tube and cooled at a rate of 1°–2°F. per minute with observations after each 5°F. drop in temperature. The temperature at which the first evidence of haziness is discernible in the oil is the Freon Haze point. On further cooling, the wax particles coalesce and individual agglomerates may be observed. The temperature at which the initial agglomerates or flocs are observed is the Freon Floc point.

The effectiveness of the lubricants of the invention was also determined in sealed tube tests which are modifications of the test described in "A Method of Evaluating Refrigerator Oils" by H. M. Elsey, L. C. Flowers and J. B. Kelley which appeared in "Refrigerating Engineering" for July 1952, pages 737–742. Briefly, the procedure employed involves putting equal amounts of the lubricant being tested and Refrigerant 12 (dichlorodifluoromethane $CCl_2F_2$) into a Pyrex glass test tube together with copper wire and a steel strip to form a couple in the oil-refrigerant mixture. The test tube is hermetically sealed and then aged at 347°F. for 14 days.

Instability in the lubricant will bring about or permit a reaction between the lubricant and Refrigerant 12 with the result that some Refrigerant 22 (Monochlorodifluoromethane $CHCl\ F_2$) is produced in the sealed tube. The amount of Refrigerant 22 produced is determined by analysing the mixture in the test tube after the 14 days accelerated aging period. An oil passes this stability test if there has been substantially no production of Refrigerant 22 during the test period.

The Frigidaire Heat Stability Test is similar to the Sealed tube stability test except that the aging is conducted at 400°F. for 14 days and decomposition of the mixture is measured by analysing for alcohol and water soluble chlorides by silver nitrate potentiometric titration rather than by analysing the contents of the tube for Refrigerant-22 as is done in the Sealed tube stability test.

One of the most important properties of a refrigeration oil is a good consolute temperature. Lubricating oils and Freon-22 (Refrigerant-22) are only partly miscible at low temperatures. Mixtures of the two tend to separate into an oil-rich supernatant phase and a Freonrich bottom phase. The consolute temperature (sometimes called the critical solution temperature of CST) is the temperature at the maximum point on the phase diagram for the system, i.e., it is the lowest temperature at which all compositions of the oil and Freon-22 can exist as a single phase. When a refrigeration system has been shut down for some time and the compressor has cooled to ambient temperature, the Freon-containing oil in the crankcase may separate into two phases if the temperature is below the consolute temperature. The Freon-rich bottom phase is a very poor lubricant, and serious damage can result during cold start-up if the bearings are submerged in the Freon-rich phase rather than the normal oil-rich mixture. The foregoing examples show the improved consolute temperatures of refrigeration oils of our process over those prepared by conventional procedures.

The lubricating oils of the invention were tested for stability in a copper plating proclivity test and in sealed tube tests. In the copper plating test, equal volumes of the oil undergoing test and carbon tetrachloride are added to a bottle together with a steel and copper couple. The bottle is sealed and maintained at an elevated temperature of 160°F. The test cells are visually observed daily for signs of galvanic action or transfer of copper to the steel strip. This is evidenced by a bright copper plating on the steel strip. In this test, unsatisfactory oils will fail in a period from 48 to 72 hours as evidenced by copper plating of the steel strip.

Various modifications of the invention as hereinbefore set forth may be made without departing from the spirit and scope thereof, and therefore, only such limitations should be made as are indicated in the appended claims.

We claim:

1. A process for the production of refrigeration oils which comprises contacting a crude petroleum lubricating oil with a hydrogenation catalyst in the presence of added hydrogen at a temperature between about 500 and 650°F. and a pressure between about 200 and 500 psig, treating the hydrofinished oil with concentrated sulfuric acid in an amount between about 15 and 60 pounds of acid per barrel of oil, removing waxy components from the acid-treated oil by complexing same with urea and separating the complex from the oil and percolating the dewaxed oil through a bed of clay.

2. The process of claim 1 in which the crude petroleum lubricating oil is a naphthenic oil having a pour point not higher than −20°F.

3. the process of claim 1 in which the acid is used in an amount between 25 and 50 pounds per barrel.

4. The process of claim 1 in which the hydrogenation catalyst comprises a Group VIII metal and a Group VI metal.

5. The process of claim 5 in which the Group VIII metal is cobalt and the Group VI metal is molybdenum.

6. The process of claim 5 in which the Group VIII metal is nickel and the Group VI metal is molybdenum.

7. The process of claim 1 in which the lubricating oil yield from the hydrogenation zone is between 95 and 100% by weight based on the charge to the hydrogenation zone.

8. The process of claim 1 in which the oil is dewaxed by being contacted with a urea-alcohol mixture and the resulting urea-wax complex is removed by filtration.

9. The process of claim 8 in which the urea-alcohol mixture contains methanol and isopropanol.

10. The process of claim 8 in which the urea-alcohol mixture contains between 300 and 600 lbs. urea and between 65 and 110 gallons of alcohol per 100 bbl. of crude lubricating oil.

* * * * *